US008947017B2

(12) United States Patent
Kikuchi et al.

(10) Patent No.: US 8,947,017 B2
(45) Date of Patent: Feb. 3, 2015

(54) SEMICONDUCTOR LIGHT SOURCE LIGHTING CIRCUIT

(71) Applicants: Satoshi Kikuchi, Shizuoka (JP); Fuminori Shiotsu, Shizuoka (JP); Takanori Namba, Shizuoka (JP); Masayasu Ito, Shizuoka (JP)

(72) Inventors: Satoshi Kikuchi, Shizuoka (JP); Fuminori Shiotsu, Shizuoka (JP); Takanori Namba, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 99 days.

(21) Appl. No.: 13/644,517

(22) Filed: Oct. 4, 2012

(65) Prior Publication Data

US 2013/0088172 A1 Apr. 11, 2013

(30) Foreign Application Priority Data

Oct. 6, 2011 (JP) ..... 2011-221891

(51) Int. Cl.
*H05B 37/02* (2006.01)
*H05B 33/08* (2006.01)

(52) U.S. Cl.
CPC ..... *H05B 33/089* (2013.01); *H05B 33/0815* (2013.01)
USPC ..... 315/307; 315/324; 315/291

(58) Field of Classification Search
None
See application file for complete search history.

(56) References Cited

U.S. PATENT DOCUMENTS 7,112,925 B2 * 9/2006 Numajiri et al. ..... 315/82
7,414,371 B1 * 8/2008 Choi et al. ..... 315/291
7,800,315 B2 * 9/2010 Shteynberg et al. ..... 315/291
7,906,943 B2 * 3/2011 Isobe et al. ..... 323/223
7,956,554 B2 * 6/2011 Shteynberg et al. ..... 315/293
8,022,634 B2 * 9/2011 Greenfeld ..... 315/192
8,134,302 B2 * 3/2012 Yang et al. ..... 315/219
8,169,147 B2 * 5/2012 Hsu et al. ..... 315/77
8,294,388 B2 * 10/2012 Wong et al. ..... 315/307
8,421,364 B2 * 4/2013 Archibald et al. ..... 315/209 R
2004/0178739 A1 9/2004 Numajiri et al.
2009/0079359 A1 3/2009 Shteynberg et al.

(Continued)

FOREIGN PATENT DOCUMENTS

CN 101754530 A 6/2010
JP 2010-170704 A 8/2010

OTHER PUBLICATIONS

Extended European Search Report for Application No. 12187175.0, mailed on Jan. 30, 2013 (5 pages).

(Continued)

*Primary Examiner* — Alexander H Taningco
*Assistant Examiner* — Nelson Correa
(74) *Attorney, Agent, or Firm* — Osha Liang LLP

(57) ABSTRACT

A circuit for lighting a semiconductor light source is provided. The circuit includes: a switching regulator including a switching element and configured to generate a drive current for the semiconductor light source using the switching element; and a control circuit configured to control on-off of the switching element such that the magnitude of the drive current comes close to a targeted value. The control circuit includes: a comparator configured to compare the magnitude of the drive current with the targeted value; an up/down counter configured to count a digital value in a counting-up direction or counting-down direction, based on a comparison result of the comparator; a digital-to-analog converter configured to convert the counted digital value into an analog signal; and a drive circuit configured to control on/off of the switching element based on the analog signal.

5 Claims, 5 Drawing Sheets

(56) References Cited

U.S. PATENT DOCUMENTS

| | | | | |
|---|---|---|---|---|
| 2009/0079360 | A1 | 3/2009 | Shteynberg et al. | |
| 2009/0174338 | A1 | 7/2009 | Muramatsu | |
| 2010/0148681 | A1 | 6/2010 | Kuo et al. | |
| 2010/0327835 | A1 | 12/2010 | Archibald | |
| 2012/0286687 | A1* | 11/2012 | Kikuchi et al. | 315/224 |
| 2012/0326632 | A1* | 12/2012 | Kitagawa | 315/307 |
| 2013/0278165 | A1* | 10/2013 | Kikuchi et al. | 315/224 |

OTHER PUBLICATIONS

Patent Abstracts of Japan for Japanese Publication No. 2010-170704, publication date Aug. 5, 2010 (1 page).

Office Action in counterpart Chinese Patent Application No. 201210375028.4, mailed May 12, 2014 (18 pages).

* cited by examiner

SEMICONDUCTOR LIGHT SOURCE LIGHTING CIRCUIT

This application claims priority from Japanese Patent Application No. 2011-221891, filed on Oct. 6, 2011, the entire contents of which are hereby incorporated by reference.

BACKGROUND

1. Technical Field

The present invention relates to a semiconductor light source lighting circuit for turning on a semiconductor light source such as an LED (light-emitting diode).

2. Related Art

In recent years, LEDs which have longer life and lower power consumption than conventional halogen lamps which use filaments have come to be used in vehicular lamps such as headlights in place of halogen lamps. The degree of light emission, that is, the brightness, of the LED strongly depends on the current flowing through it. Therefore, to use LEDs as a light source, a lighting circuit for adjusting the current flowing through the LEDs is necessary. Usually, such a lighting circuit has an error amplifier and performs a feedback control so as to keep the current flowing through the LEDs constant.

For example, in the case of headlights, to realize both of a high-beam mode and a low-beam mode properly and to satisfy a standard more easily, it is desirable that the brightness of LEDs be adjustable. Two methods for changing the brightness of LEDs are known which are a method of changing the current value continuously and a PWM (pulse width modulation) dimming method of changing the on/off duty ratio of a current. The former method has a color shift problem that the hue or the color temperature may vary depending on the current value. Therefore, in many cases, LED lighting circuits for vehicular lamps employ the latter, PWM dimming method.

The present applicant proposed a lighting control device which employs PWM dimming (see e.g., JP-A-2010-170704).

In the lighting control device disclosed in JP-A-2010-170704, the value of an LED current that was detected during a drive period of a switching regulator is held in an analog manner using a capacitor in a suspension period that follows the drive period. However, in general, the capacitor has a loss and hence the voltage held by the capacitor varies gradually. To restore an LED current value before a suspension period when a transition is made from the suspension period to a drive period, it is necessary to return a voltage that has varied in the suspension period as mentioned above to an original value. However, in general, the voltage of the capacitor varies more slowly than the LED current rises. Therefore, the LED current may overshoot, that is, it may reach a targeted value before the voltage returns to the original value and exceed the targeted value.

Similar phenomena occur in cases other than the PWM dimming. When the input voltage of a lighting control circuit or the number of LEDs to be driven is changed suddenly, the error amount in a current feedback loop may not be able to respond to such a sudden change properly, possibly resulting in an overshoot or undershoot of the LED current.

SUMMARY OF THE DISCLOSURE

Some implementations of the present invention may address the foregoing issue as well as other issues. However, the present invention is not required to overcome the disadvantages described above and thus, some implementations of the present invention may not overcome these disadvantages.

In one aspect, the present disclosure describes a semiconductor light source lighting circuit capable of suppressing an overshoot or undershoot of a drive current of a semiconductor light source.

According to one or more illustrative aspects of the present invention, there is provided a circuit (100) for lighting a semiconductor light source (40). The circuit includes: a switching regulator (104) comprising a switching element (122) and configured to generate a drive current ($I_{LED}$) for the semiconductor light source from an input voltage ($V_{in}$) using the switching element, wherein the input voltage varies between a first voltage corresponding to an active state of the switching regulator and a second voltage corresponding to an inactive state of the switching regulator repeatedly, and wherein the switching regulator generates the drive current in the active state, and the switching regulator does not generate the drive current in the inactive state; and a control circuit (100) configured to control on-off of the switching element such that the magnitude of the drive current comes close to a targeted value. The control circuit comprises: a comparator (116) configured to compare the magnitude of the drive current with the targeted value; an up/down counter (118) configured to count a digital value in a counting-up direction or a counting-down direction, based on a comparison result of the comparator; a determination circuit (150) configured to determine whether or not the input voltage deviates from the first voltage based on the magnitude of the drive current; a register (162) configured to acquire the counted digital value and hold the acquired digital value while the determination circuit determines that the input voltage deviates from the first voltage; a digital-to-analog converter (120) configured to convert the counted digital value into an analog signal; and a drive circuit (106) configured to control on-off of the switching element based on the analog signal. The up/down counter reads out the digital value held by the register as a digital value counted by the up/down counter when the switching regulator makes a transition from the inactive state to the active state.

According to this aspect of the invention, a result of comparison between the magnitude of the drive current and the targeted value can be held digitally while the determination circuit determines that the input voltage deviates from the first voltage.

According to one or more illustrative aspects of the present invention, there is provided a circuit (100) for lighting a semiconductor light source (40). The circuit includes: a switching regulator (104) comprising a switching element (122) and configured to generate a drive current ($I_{LED}$) for the semiconductor light source using the switching element; and a control circuit (100) configured to control on-off of the switching element such that the magnitude of the drive current comes close to a targeted value. The control circuit comprises: a comparator (116) configured to compare the magnitude of the drive current with the targeted value; an up/down counter (118) configured to count a digital value in a counting-up direction or counting-down direction, based on a comparison result of the comparator; a digital-to-analog converter (120) configured to convert the counted digital value into an analog signal; and a drive circuit (106) configured to control on/off of the switching element based on the analog signal. The up-down counter is configured to count the digital value at a higher rate as a difference between the magnitude of the drive current and the targeted value is increased.

According to this aspect of the invention, a result of comparison between the magnitude of the drive current and the targeted value can be handled digitally.

An arbitrary combination from the above constituent elements and what is obtained by mutual replacement of constituent elements or representations of the invention between apparatus, methods, systems, or the like are effective as modes of the invention.

The invention makes it possible to suppress an overshoot or undershoot of a drive current of a semiconductor light source.

DETAILED DESCRIPTION

Figure 1:
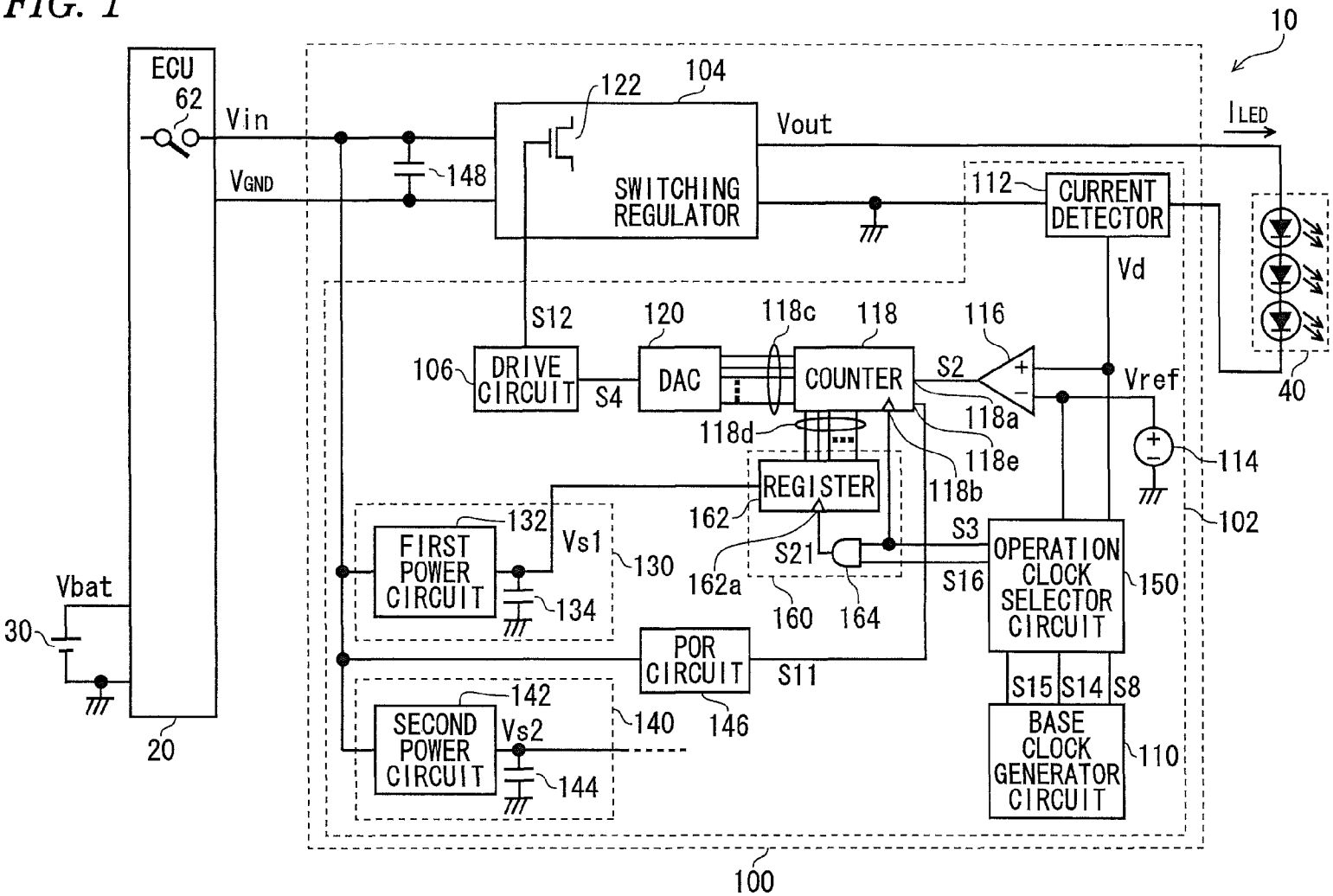
FIG. 1 is a circuit diagram showing the configuration of an in-vehicle circuit having a semiconductor light source lighting circuit according to an embodiment.

Hereinafter, the same or equivalent components, members, and signals, which are shown in the respective drawings, are denoted by the same reference numerals, and the repeated description thereof will be appropriately omitted. Further, some of members, which are not important in the description, will be omitted in the respective drawings.

In the following, the same or equivalent constituent elements, members, or signals shown in the drawings are given the same reference symbol and redundant descriptions will be avoided where appropriate. In the drawings, part of members that are not important for descriptions may be omitted. Symbols that denote voltages, currents, resistors, etc. may also be used as representing voltage values, current values, resistance values, etc. when necessary.

In this specification, a phrase "a state that a member A is connected to a member B" means not only a case that the member A is connected to the member B physically and directly but also a case that the member A is connected to the member B indirectly via another member that does not influence their electrical connection state.

FIG. 1 is a circuit diagram showing the configuration of an in-vehicle circuit 10. The in-vehicle circuit 10 is equipped with a semiconductor light source lighting circuit 100 according to the embodiment, an engine controller 20, a vehicular battery 30, and an LED light source 40 which are a series connection of three vehicular LEDs. The LED light source 40 may be configured in such a manner that the lighting/non-lighting of the LEDs can be controlled individually by means of bypass switches or the like (not shown).

The engine controller 20 is a microcontroller which performs electrical controls of the vehicle comprehensively. The engine controller 20 is supplied with a battery voltage Vbat of about 12 V by the vehicular battery 30 connected to it. The engine controller 20 supplies the semiconductor light source lighting circuit 100 with a fixed voltage, that is, a ground potential $V_{GND}$ (=0 V).

The engine controller 20 has the following two modes which relates to control of the LED light source 40.

1. PWM Dimming Mode

In the PWM dimming mode, the engine controller 20 generates an input voltage Vin which varies like a rectangular wave at a dimming frequency f1 which is several hundred hertz to several kilohertz, using a dimming switching element 62. When the dimming switching element 62 is switched on, the input voltage Vin is increased to a supply voltage of about 13 V, for example, which is approximately equal to the battery voltage Vbat. When the dimming switching element 62 is switched off, the input voltage Vin is increased to the ground potential $V_{GND}$. The variation cycle (=1/f; called a dimming cycle T1 below) of the input voltage Vin is set longer than its rise and fall transition times. Therefore, the input voltage Vin varies repeatedly between a voltage around the supply voltage and a voltage around the ground potential $V_{GND}$. The engine controller 20 supplies the generated input voltage Vin to the semiconductor light source lighting circuit 100.

Because of the above pulse modulation of the input voltage Vin, the LED light source 40 flashes at the dimming frequency f1 and the brightness as perceived by the human eyes is reduced. The duty ratio of the input voltage Vin is set to produce a desired degree of light emission. In this case, the variation of the magnitude of the current flowing through the LED light source 40 while it is lit is decreased and hence a color shift can be suppressed.

In the following, that the semiconductor light source lighting circuit 100 is supplied with power from the vehicular battery 30 via the engine controller 20 with the dimming switching element 62 on may be referred to as "supply of the input voltage Vin." And that the supply of power from the vehicular battery 30 to the semiconductor light source lighting circuit 100 is suspended with the dimming switching element 62 off may be referred to as "shutoff of the input voltage Vin."

2. Non-dimming Mode

In the non-dimming mode, basically, the engine controller 20 supplies the supply voltage to the semiconductor light source lighting circuit 100 as the input voltage Vin. However, when a heavy load is imposed on the vehicular battery 30 suddenly at the time of a start of the engine, for example, the battery voltage Vbat is decreased. The battery voltage Vbat increases once that load disappears. The input voltage Vin is varied accordingly, and may be shifted to a sudden change voltage of about 16 V, for example, which is different from the supply voltage.

The semiconductor light source lighting circuit 100 includes a control circuit 102, a switching regulator 104, and an input capacitor 148.

The input capacitor 148 is provided on the input side of the switching regulator 104. The input voltage Vin is applied to one end of the input capacitor 148 and the ground potential $V_{GND}$ is applied to the other end. Having a relatively large capacitance, the input capacitor 148 is configured to increase operation stability and reduce radio noise. The input capacitor 148 may be part of the switching regulator 104.

The switching regulator 104 converts the input voltage Vin which is input from the engine controller 20 into an output voltage Vout which is suitable for a forward voltage Vf of the LED light source 40 using a switching element 122 which may be a MOSFET (metal-oxide-semiconductor field-effect transistor) or the like, and applies the output voltage Vout to the anode of the high-voltage-side end LED of the LED light source 40. From the viewpoint of current, the switching regulator 104 generates a drive current $I_{LED}$ to flow through the LED light source 40 from the input voltage Vin using the switching element 122. The switching regulator 104 is supplied with the ground potential $V_{GND}$ from the engine controller 20.

The switching regulator 104 generates a drive current $I_{LED}$ using the switching element 122 while the input voltage Vin is higher than or equal to a lowest operation voltage of the switching regulator 104. The switching regulator 104 does not generate a drive current $I_{LED}$ while the input voltage Vin is lower than the lowest operation voltage of the switching regulator 104. A state that the switching regulator 104 is generating a drive current $I_{LED}$ now called an active state. Then, in the PWM dimming mode, the input voltage Vin varies repeatedly between the supply voltage or a sudden change voltage which corresponds to the active state and a voltage around the ground potential $V_{GND}$ which corresponds to an inactive state.

The control circuit 102 on/off-controls the switching element 122 so that the magnitude of the drive current $I_{LED}$ comes close to a targeted value. The control circuit 102 includes a drive circuit 106, a D/A converter 120, an up/down counter 118, an error comparator 116, a current detector 112, an operation clock selector circuit 150, a base clock generator circuit 110, a holder circuit 160, a reference voltage source 114, a first control power circuit 130, a second control power circuit 140, and a POR (power on reset) circuit 146.

The current detector 112 detects the magnitude of the drive current $I_{LED}$. The current detector 112, which is, for example, a current detection resistor through which the drive current $I_{LED}$ flows, generates a detection voltage Vd according to the magnitude of the drive current $I_{LED}$ and applies the detection voltage Vd to the non-inverting input terminal of the error comparator 116. Furthermore, the current detector 112 supplies the detection voltage Vd to the operation clock selector circuit 150. The detection voltage Vd is generated using, as a reference voltage, a fixed voltage such as the ground potential $V_{GND}$.

The reference voltage source 114 generates a reference voltage Vref which corresponds to a targeted value of the magnitude of the drive current $I_{LED}$ and applies the reference voltage Vref to the inverting input terminal of the error comparator 116. Furthermore, the reference voltage source 114 supplies the reference voltage Vref to the operation clock selector circuit 150. The reference voltage Vref is generated using a fixed voltage as a reference voltage.

The error comparator 116 compares the detection voltage Vd with the reference voltage Vref. That is, the error comparator 116 compares the magnitude of the drive current $I_{LED}$ indicated by the detection voltage Vd with the targeted value indicated by the reference voltage Vref. The error comparator 116 outputs, to the up/down counter 118, an error signal S2 which is asserted or negated according to the magnitude relationship between the detection voltage Vd and the reference voltage Vref. In particular, when Vd≥Vref, the error signal S2 is asserted and its voltage becomes a high level. When Vd<Vref, the error signal S2 is negated and its voltage becomes a low level.

The up/down counter 118 counts a control digital value in the counting direction that is determined according to the comparison result of the error comparator 116. The up/down counter 118 may be a device having the same function as '191 of the 74 series which is a standard logic IC series. The up/down counter 118 has an U/D control terminal 118*a* to which the error signal S2 is input, a clock pulse input terminal 118*b* to which an operation clock signal S3 is input, output terminals 118*c* whose number corresponds to the number of bits of a digital value to be counted, data input terminals 118*d* whose number corresponds to the number of bits of a digital value to be counted, and a load terminal 118*e* for a control as to whether or not a digital value that is input to the data input terminals 118*d* should be loaded as a control digital value.

The up/down counter 118 outputs a control digital value to the D/A converter 120 from its output terminals 118*c*.

Table 1 is a truth table relating to the up/down counter 118. In Table 1, "L" means a low level, "H" means a high level, and "X" means any level (don't care).

TABLE 1

| Load terminal 118e | U/D control terminal 118a | Clock pulse input terminal 118b | Operation |
|---|---|---|---|
| L | X | X | Load |
| H | H | Rising edge (L → H) | Count up |
| H | L | Rising edge (L → H) | Count down |

When a signal that is input to the load terminal 118*e* is at the low level, the up/down counter 118 loads, as a control digital value to be output from the output terminals 118*c*, a digital value that is input to the data input terminals 118*d*. Since a digital value that is held by a register 162 is input to the data input terminals 118*d*, the digital value being held by the register 162 is read from the up/down counter 118 as a control digital value when a signal that is input to the load terminal 118*e* is at the low level.

The D/A converter 120 converts the control digital value that is output from the output terminals 118*c* into a duty ratio setting signal S4 having an analog voltage that corresponds to the control digital value. The digital-to-analog conversion processing itself which is performed in the D/A converter 120 may be performed using a known digital-to-analog conversion technique. The D/A converter 120 outputs the duty ratio setting signal S4 to the drive circuit 106. The voltage of the duty ratio setting signal S4 is higher when the control digital value is larger.

The drive circuit 106 controls the on/off duty ratio of the switching element 122 according to the duty ratio setting signal S4 which is obtained through the conversion by the D/A converter 120. The drive circuit 106 compares a sawtooth signal whose voltage varies in a sawtooth-like manner at a switching frequency f2 of several ten kilohertz to several hundred kilohertz, for example, which is higher than the dimming frequency f1 with the duty ratio setting signal S4. The drive circuit 106 generates, through the above comparison, a device control signal S12 whose voltage varies in a rectangular-wave-like manner at the switching frequency f2 and duty ratio corresponds to the voltage of the duty ratio setting signal S4. The high-side duty ratio of the device control signal S12 decreases as the voltage of the duty ratio setting signal S4 increases. The drive circuit 106 outputs the generated device control signal S12 to the gate of the switching element 122. As a result, as the control digital signal increases, the on duty ratio of the switching element 122 decreases, which serves to decrease the drive current $I_{LED}$. In this manner, the control circuit 102 performs a current feedback control so that the drive current $I_{LED}$ comes close to the targeted value.

The base clock generator circuit 110 generates a base clock signal S8 whose voltage varies in a rectangular-wave-like manner at a base clock frequency f3 of several ten kilohertz to several hundred kilohertz, for example, which is higher than the dimming frequency f1, and outputs the base clock signal S8 to the operation clock selector circuit 150. Furthermore, the base clock generator circuit 110 generates signals whose frequencies are lower than the base clock frequency f3. In particular, the base clock generator circuit 110 generates a ¼ frequency-divided clock signal S14 by frequency-dividing the base clock signal S8 by 4 and generates a 1/16 frequency-divided clock signal S15 by frequency-dividing the base clock signal S8 by 16. The base clock generator circuit 110 outputs the ¼ frequency-divided clock signal S14 and the 1/16 frequency-divided clock signal S15 to the operation clock selector circuit 150.

The operation clock selector circuit 150 has the following two functions:

Function 1: A function, necessary to serve as a determination circuit, of determining, on the basis of the magnitude of the drive current $I_{LED}$, whether or not the input voltage Vin deviates from the supply voltage.

Function 2: A function, to serve as an operation clock generator, of generating an operation clock signal S3 whose frequency increases as the difference between the magnitude of the drive current $I_{LED}$ and the targeted value increases.

As for function 1, the operation clock selector circuit 150 compares the detection voltage Vd with the reference voltage Vref and thereby determines whether or not the difference or ratio between the magnitude of the drive current $I_{LED}$ and the targeted value is within a prescribed error range. The error range includes a value "0" in the case where the difference is determined, and includes a value "1" in the case where the ratio is determined. In the embodiment, a state that the difference or ratio between the magnitude of the drive current $I_{LED}$ and the targeted value is within the prescribed error range is correlated with a determination that the input voltage Vin does not deviate from the supply voltage. And a state that the difference or ratio between the magnitude of the drive current $I_{LED}$ and the targeted value is not within the prescribed error range is correlated with a determination that the input voltage Vin deviates from the supply voltage. The operation clock selector circuit 150 outputs, to the holder circuit 160, a holding control signal S16 whose level varies according to the result of the above determination. The voltage of the holding control signal S16 becomes a high level if it is determined that the difference or ratio between the magnitude of the drive current $I_{LED}$ and the targeted value is within the prescribed error range, and becomes a low level if not.

As for function 2, the operation clock selector circuit 150 selects, as an operation clock signal S3, one of the base clock signal S8, the ¼ frequency-divided clock signal S14, and the 1/16 frequency-divided clock signal S15 according to the result of the comparison between the detection voltage Vd and the reference voltage Vref. In particular, the operation clock selector circuit 150 selects a signal having a higher frequency as the difference between the magnitude of the drive current $I_{LED}$ and the targeted value increases. The operation clock selector circuit 150 outputs the operation clock signal S3 to the holder circuit 160 and the clock pulse input terminal 118*b* of the up/down counter 118.

Table 2 is a table relating to the functions of the operation clock selector circuit 150.

TABLE 2

| (Current detection value)/(targeted value) | Operation clock signal S3 | Holding control signal S16 |
|---|---|---|
| ≥140% | Base clock signal S8 | L |
| 115%-140% | ¼ frequency-divided clock signal S14 | L |
| 85%-115% | 1/16 frequency-divided clock signal S15 | H |
| 60%-85% | ¼ frequency-divided clock signal S14 | L |
| <60% | Base clock signal S8 | L |

In Table 2, the range "85%-115%" is the error range for the ratio of the drive current to the targeted value. The ranges "115%-140%" and "larger than or equal to 140%" are a first deviation range and a second deviation range, respectively. The ranges "60%-85%" and "smaller than 60%" are a third deviation range and a fourth deviation range, respectively.

Figure 2:
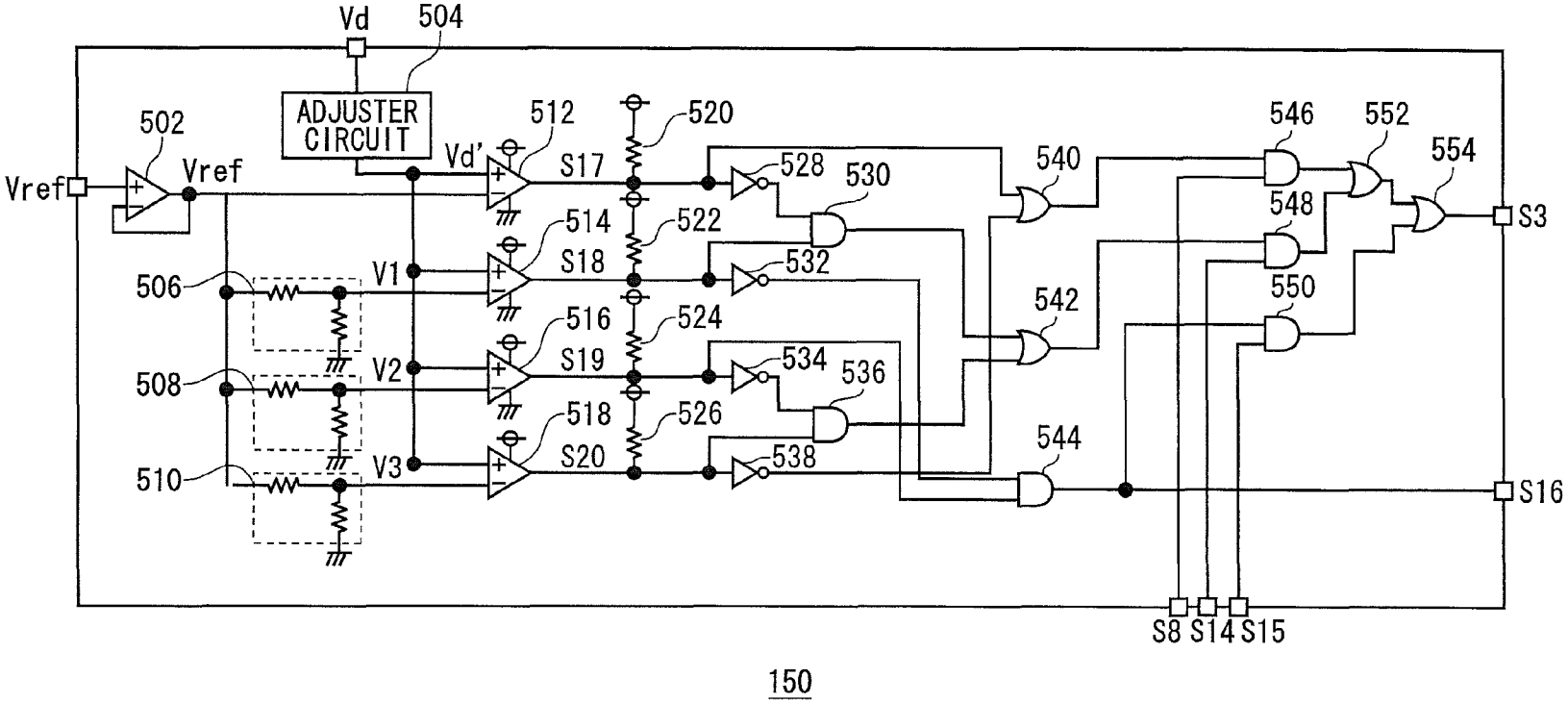
FIG. 2 is a circuit diagram showing the configuration of an operation clock selector circuit shown in FIG. 1.

FIG. 2 is a circuit diagram showing the configuration of the operation clock selector circuit 150. The operation clock selector circuit 150 is mainly composed of a voltage division circuit group, a comparator group, and a logic gate group. A buffer 502 receives and buffers the reference voltage Vref which is input to the operation clock selector circuit 150. A first voltage division circuit 506, a second voltage division circuit 508, and a third voltage division circuit 510 generate a first divisional voltage V1, a second divisional voltage V2, and a third divisional voltage V3, respectively, by dividing the reference voltage Vref which is output from the buffer 502. In particular, the resistance values of the voltage division circuits 506, 508, and 510 are set so as to establish a relationship Vref>V1>V2>V3.

The adjuster circuit 504 receives the detection voltage Vd which is input to the operation clock selector circuit 150, and adjusts it into a processed detection voltage Vd'. The circuit constants of the first voltage division circuit 506, the second voltage division circuit 508, the third voltage division circuit 510, and the adjuster circuit 504 are set so that a range V1>Vd'≥V2 becomes the error range, a range Vref>Vd'≥V1 becomes the first deviation range, a range Vd'≥Vref becomes the second deviation range, V2>Vd'≥V3 becomes the third deviation range, and a range V3>Vd' becomes the fourth deviation range.

A first comparator 512, a second comparator 514, a third comparator 516, and a fourth comparator 518 compare the processed detection voltage Vd' with the reference voltage Vref, the first divisional voltage V1, the second divisional voltage V2, and the third divisional voltage V3, respectively, and generates a first comparison signal S17, a second comparison signal S18, a third comparison signal S19, and a fourth comparison signal S20 whose voltages become a high level if the processed detection voltage Vd' is higher than or equal to the voltages Vref and V1-V3, respectively, and become a low level if the processed detection voltage Vd' is lower than the voltages Vref and V1-V3, respectively. A first resistor 520, a second resistor 522, a third resistor 524, and a fourth resistor 526 are pull-up resistors for the first comparator 512, the second comparator 514, the third comparator 516, and the fourth comparator 518, respectively.

A first inverter 528, a second inverter 532, a third inverter 534, and a fourth inverter 538 invert the levels of the first comparison signal S17, the second comparison signal S18, the third comparison signal S19, and the fourth comparison signal S20, respectively.

A second AND gate 530 outputs the AND of an output signal of the first inverter 528 and the second comparison signal S18. A third AND gate 536 outputs the AND of an output signal of the third inverter 534 and the fourth comparison signal S20. A first OR gate 540 outputs the OR of the first comparison signal S17 and an output signal of the fourth inverter 538. A second OR gate 542 outputs the OR of an output signal of the second AND gate 530 and an output signal of the third AND gate 536. A seventh AND gate 544 outputs the AND of an output signal of the second inverter 532 and the third comparison signal S19.

A fourth AND gate 546 outputs the AND of an output signal of the first OR gate 540 and the base clock signal S8. A fifth AND gate 548 outputs the AND of an output signal of the second OR gate 542 and the ¼ frequency-divided clock signal S14. A sixth AND gate 550 outputs the AND of an output signal of the seventh AND gate 544 and the 1/16 frequency-divided clock signal S15.

A fourth OR gate 552 outputs the OR of an output signal of the fourth AND gate 546 and an output signal of the fifth AND gate 548. A fifth OR gate 554 outputs the OR of an output signal of the fourth OR gate 552 and an output signal of the sixth AND gate 550.

The operation clock selector circuit 150 outputs an output signal of the fifth OR gate 554 as the operation clock signal S3, and outputs the output signal of the seventh AND gate 544 as the holding control signal S16.

For example, if V1>Vd'>V2, the voltages of the first comparison signal S17 and the second comparison signal S18 become a low level and the fourth comparison signal becomes a high level. Since the voltages of the first comparison signal S17 and the fourth inverter 538 are at the low level, the voltage of the output signal of the first OR gate 540 becomes a low level. Therefore, the voltage of the output signal of the fourth AND gate 546 becomes a low level irrespective of the level of the base clock signal S8. Since the output signal of the second OR gate 542 is also at the low level, the voltage of the output signal of the fifth AND gate 548 also becomes a low level irrespective of the level of the ¼ frequency-divided clock signal S14. On the other hand, since the voltage of the output signal of the seventh AND gate 544 becomes a high level, the level of the output signal of the sixth AND gate 550 becomes equal to that of the 1/16 frequency-divided clock signal S15. As a result, the level of the 1/16 frequency-divided clock signal S15 is output as the level of the operation clock signal S3 and the voltage of the holding control signal S16 is made a high level.

As described above, the operation clock signal S3 and the holding control signal S16 are realized by the operation clock selector circuit 150 of FIG. 2.

Returning to FIG. 1, the holder circuit 160 includes the register 162 and a first AND gate 164. The first AND gate 164 outputs the AND of the operation clock signal S3 and the holding control signal S16. The level of the output signal of the first AND gate 164 is equal to that of the operation clock signal S3 if it is determined that the difference or ratio between the drive current $I_{LED}$ and the targeted value is within the error range, and is kept at the low level if not.

The register 162 acquires a control digital value from the up/down counter 118 if a condition that the operation clock selector circuit 150 determines that the input voltage Vin does not deviate from the supply voltage is satisfied as one of conditions. The register 162 holds the acquired control digital value while the operation clock selector circuit 150 determines that the input voltage Vin deviates from the supply voltage.

A device having a loading function and a holding function such as '191 of the 74 series may be employed as the register 162. The register 162 has output terminals which are connected to the data input terminals 118*d* of the up/down counter 118, input terminals which are connected to the output terminals 118*c* of the up/down counter 118 (this connection relationship is not shown in FIG. 1), and a clock terminal 162*a* to which the output signal S21 of the first AND gate 164 is input.

When a rising edge is input to its clock terminal 162*a*, the register 162 loads a control digital value that is input to its input terminals. That is, a control digital value occurring in the up/down counter 118 when a rising edge is input to the clock terminal 162*a* appears at the output terminals of the register 162. In this manner, the register 162 updates the digital value at the frequency of the operation clock signal S3 if it is determined that the difference or ratio between the drive current $I_{LED}$ and the targeted value is within the error range, and, if not, holds a last-updated digital value or a digital value that occurred immediately before update suspension.

The first control power circuit 130 supplies power to at least the register 162. The first control power circuit 130 has a first power circuit 132 and a first capacitor 134. The first power circuit 132 generates, using the input voltage Vin, a first power voltage Vs1 to be supplied to the register 162.

The first control power circuit 130 is configured so as to supply a sufficiently high power voltage to the register 162 while the input voltage Vin is close to the ground potential $V_{GND}$ in the PWM dimming mode. More specifically, one end of the first capacitor 134 is connected to the output of the first power circuit 132 and the other end is grounded. The capacitance of the first capacitor 134 is set so that the first power voltage Vs1 of the first control power circuit 130 can be kept higher than a value that is necessary for driving of the register 162 while the input voltage Vin is close to the ground potential $V_{GND}$. This allows at least the register 162 to continue its operation while the input voltage Vin is close to the ground potential $V_{GND}$.

The second control power circuit 140 supplies power to the circuit elements other than the ones that are supplied with power by the first control power circuit 130. The second control power circuit 140 may supply power to the up/down counter 118. The second control power circuit 140 has a second power circuit 142 and a second capacitor 144. The second power circuit 142 generates, using the input voltage Vin, a second power voltage Vs2. One end of the second capacitor 144 is connected to the output of the second power circuit 142 and the other end is grounded. The capacitance of the second capacitor 144 is smaller than that of the first capacitor 134.

The POR circuit 146 monitors the input voltage Vin and generates a POR signal S11. The POR signal S11 makes a transition from the high level to the low level when the input voltage Vin becomes lower than a prescribed first POR voltage, and makes a transition from the low level to the high level when the input voltage Vin becomes higher than a second POR voltage which is higher than the first POR voltage. The second POR voltage is lower than the supply voltage. The POR circuit 146 supplies the generated POR signal S11 to the load terminal 118*e* of the up/down counter 118. The POR circuit 146 may also supply the generated POR signal S11 to other circuit elements if necessary.

In the PWM dimming mode, the input voltage Vin varies repeatedly between a voltage around the supply voltage and a voltage around the ground potential $V_{GND}$ at the dimming frequency f1. Therefore, the high level and the low level of the POR signal S11 correspond to the active state and the inactive state of the switching regulator 104.

How the above-configured semiconductor light source lighting circuit 100 operates will be described below.

(PWM Dimming Mode)

Figure 3:
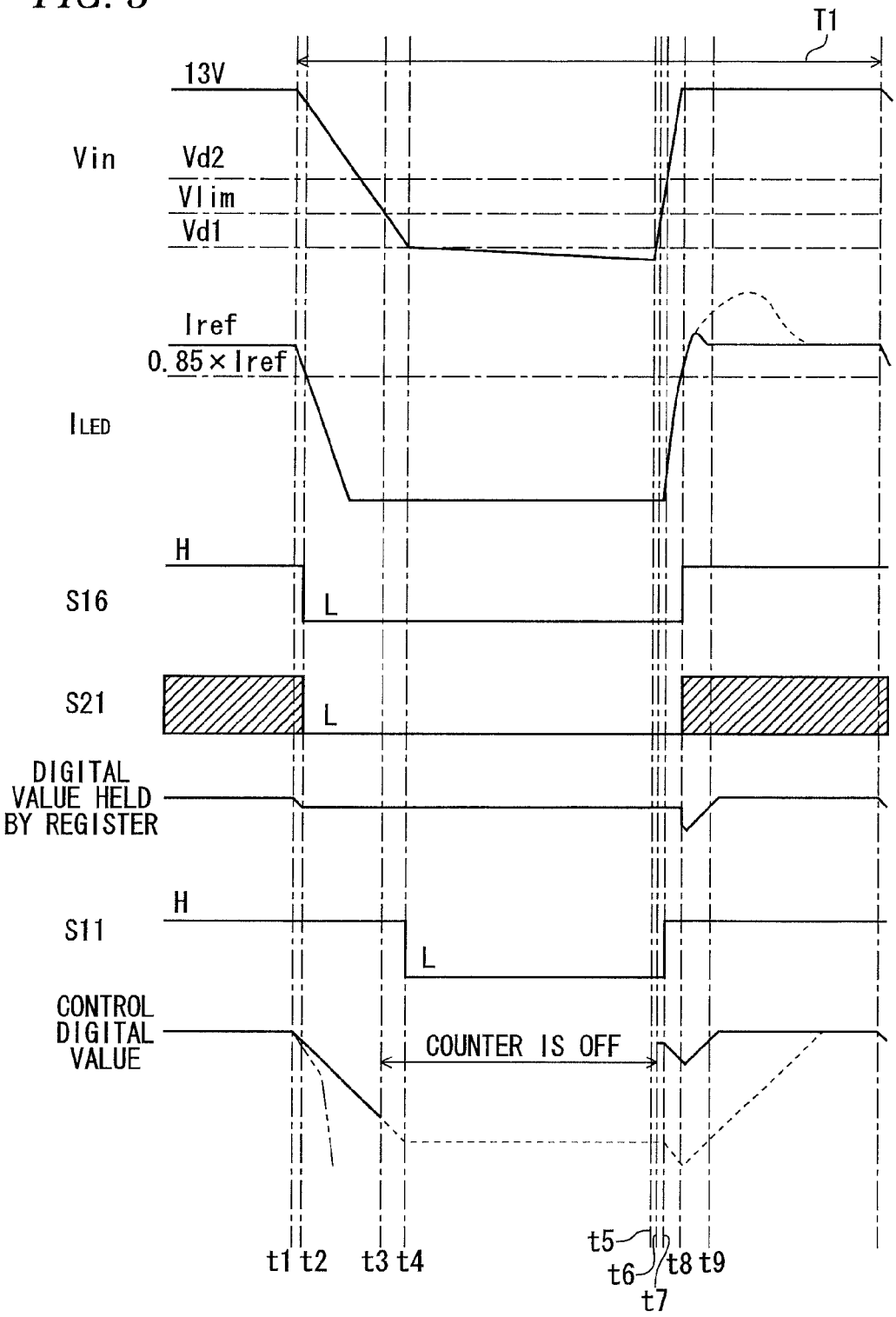
FIG. 3 is a time chart showing how the semiconductor light source lighting circuit of FIG. 1 operates in a PWM dimming mode.

FIG. 3 is a time chart showing how the semiconductor light source lighting circuit 100 operates in the PWM dimming mode. FIG. 3 shows, in order from top to bottom, the input voltage Vin, the drive current $I_{LED}$, holding control signal S16, the output signal S21 of the first AND gate 164, the digital value held by the register 162, the POR signal S11, and the control digital value of the up/down counter 118. Hatched regions of the output signal S21 of the first AND gate 164 mean that the output signal S21 varies repeatedly between the high level and the low level at the frequency that is 1/16 of the base clock frequency f3. The frequency that is 1/16 of the base clock frequency f3 is sufficiently higher than the dimming frequency f1.

At time t1, the input voltage Vin is shut off and starts to decrease from the supply voltage (13 V). The drive current $I_{LED}$ also starts to decrease from a targeted value Iref. The input voltage Vin does not drop to the ground potential $V_{GND}$ instantaneously; it decreases at a certain slope because of the presence of the input capacitor 148. The input voltage Vin decreases at a smaller slope than the drive current $I_{LED}$.

While the drive current $I_{LED}$ decreases, the error signal S2 is at the low level and hence the up/down counter 118 counts down the control digital value according to the operation clock signal S3. Therefore, the control digital value decreases. The decrease of the control digital value serves to increase the output of the switching regulator 104. To prevent oscillation of the current feedback control, the up/down counter 118 is configured so as to vary the control digital value relatively slowly.

The register 162 reads control digital values from the up/down counter 118 as the output signal S21 of the first AND gate 164 makes level transitions.

Although the input voltage Vin is decreasing, the control digital value of the up/down counter 118 varies relatively slowly and hence the switching regulator 104 cannot perform voltage conversion satisfactorily. As a result, the drive current $I_{LED}$ decreases relatively steeply.

At time t2, the drive current $I_{LED}$ becomes smaller than 0.85 times the targeted value Iref. The holding control signal S16 makes a transition from the high level to the low level. Therefore, the output signal S21 of the first AND gate 164 comes to be kept at the low level. Since no edge appears at the clock terminal 162*a*, the register 162 suspends the update of the digital value and holds a last-updated digital value. The up/down counter 118 continues the countdown operation.

Such a value of the input voltage Vin that the second power voltage Vs2 which is generated from the input voltage Vin becomes lower than a minimum operation voltage of the up/down counter 118 if the up/down counter 118 is lower than that value is called an operation limit voltage Vlim. The input voltage Vin becomes lower than the operation limit voltage Vlim at time t3. The up/down counter 118 is turned off, whereupon the control digital value become indefinite. The speed of the counting operation of the up/down counter 118 from time t2 to time t3 will be described later.

At time t4, the input voltage Vin becomes lower than the first POR voltage Vd1. The POR signal S11 makes a transition from the high level to the low level. Since the operation of the switching regulator 104 is suspended, the decrease of the input voltage Vin and the consumption of the energy stored in the input capacitor 148 are made slower.

At time t5, supply of the input voltage Vin is restarted. The input voltage Vin starts to increase toward the supply voltage.

At time t6, the input voltage Vin becomes higher than the operation limit voltage Vlim. Since the POR signal S11 is at the low level, the up/down counter 118 does not perform a countdown operation and reads a digital value held by the register 162 as a control digital value. That is, when the switching regulator 104 makes a transition from the inactive state to the active state, the up/down counter 118 reads a digital value held by the register 162 as a control digital value.

In the period from time t2 to time t6, the register 162 is supplied with a sufficiently high power voltage by the first control power circuit 130 and holds a control digital value that occurred at time t2. Therefore, the digital value that is held by the register 162 at time t6 is equal to the digital value that was held by it at time t2.

At time t7, the input voltage Vin becomes higher than the second POR voltage Vd2. The POR voltage makes a transition from the low level to the high level. The switching regulator 104 starts operating and the drive current $I_{LED}$ starts to increase toward the targeted value Iref. The up/down counter 118 starts a counting operation. At time t7, since the drive current $I_{LED}$ is still smaller than the targeted value Iref, the up/down counter 118 counts down the control digital value according to the operation clock signal S3.

In the embodiment, the second POR voltage Vd2 is set higher than the operation limit voltage Vlim so that the voltage of the POR signal turns to the high level after turning-on of the up/down counter 118.

At time t8, the drive current $I_{LED}$ becomes larger than 0.85 times the targeted value Iref. The holding control signal S16 makes a transition from the low level to the high level. Clock pulses whose frequency is 1/16 of the base clock frequency f3 appear as the output signal S21 of the first AND gate 164. The register 162 updates the digital value according to those clock pulses.

The control digital value that occurred at time t2 is smaller than the control digital value that occurred at time t1. Therefore, the drive current $I_{LED}$ overshoots from a time (after time t8) when the drive current $I_{LED}$ reaches the targeted value Ira to a time when the control digital value returns to the valued that occurred at time t1. At time t9, the control digital value returns to the value that occurred at time t1.

(Sudden Change of Input Voltage Vin in Non-dimming Mode)

Figure 4:
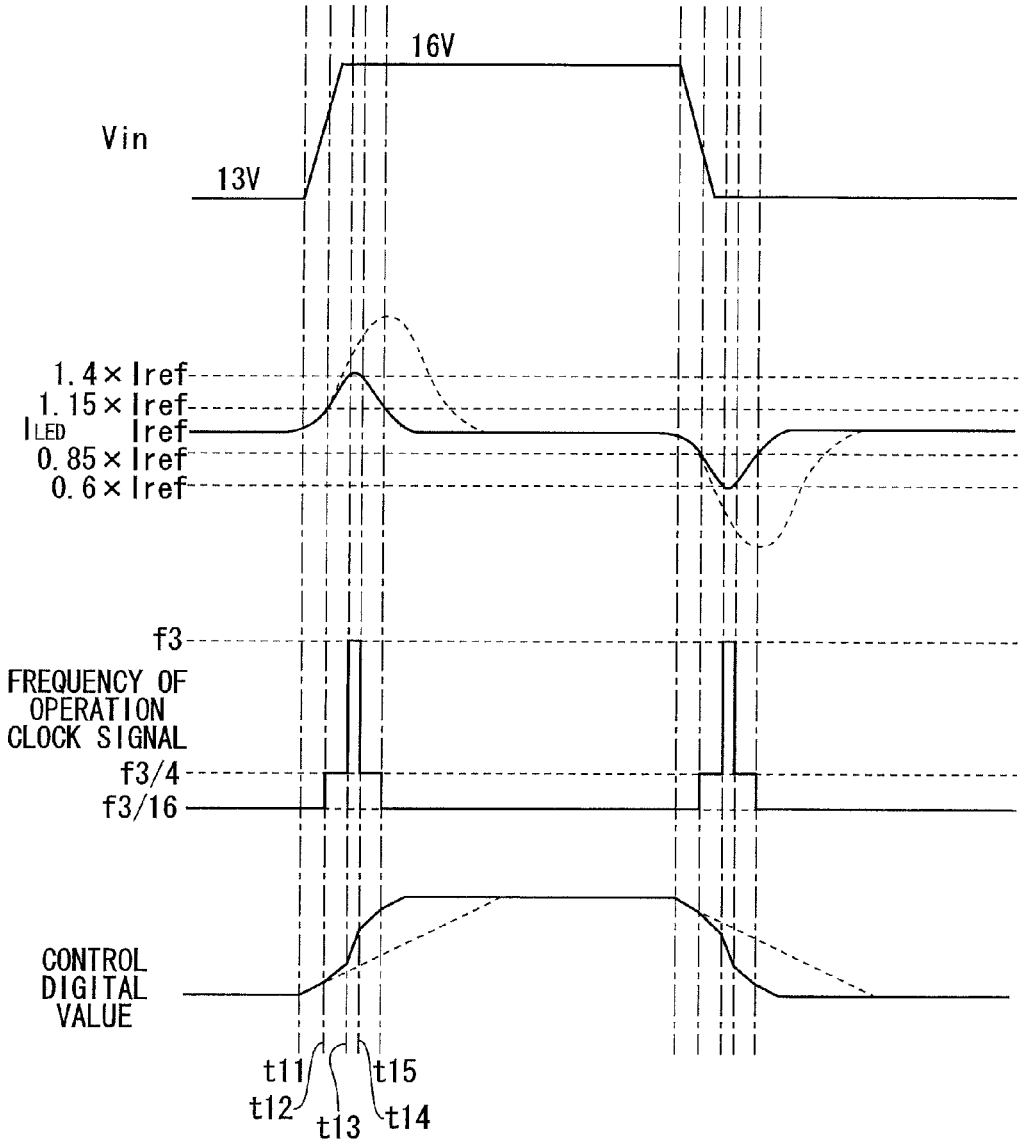
FIG. 4 is a time chart showing how the semiconductor light source lighting circuit of FIG. 1 operates as the input voltage changes suddenly in a non-dimming mode.

FIG. 4 is a time chart showing how the semiconductor light source lighting circuit 100 operates as the input voltage Vin changes suddenly in the non-dimming mode. FIG. 4 shows, in order from top to bottom, the input voltage Vin, the drive current $I_{LED}$, the frequency of the operation clock signal S3, and the control digital value of the up/down counter 118.

At time t11, the input voltage Vin starts to vary from the supply voltage (13 V) to a sudden change voltage (16 V). The drive current $I_{LED}$ also starts to increase from the targeted value Iref. Since the drive current $I_{LED}$ becomes larger than the targeted value Iref, the up/down counter 118 counts up the control digital value. The 1/16 frequency-divided clock signal S15 is selected as the operation clock signal S3 of the operation clock selector circuit 150, and hence the frequency of the operation clock signal S3 is 1/16 of the base clock frequency f3. Therefore, the count-up speed is relatively slow and the drive current $I_{LED}$ continues to increase.

At time t12, the drive current $I_{LED}$ becomes larger than 1.15 times the targeted value Iref. The operation clock selector circuit 150 selects the 1/4 frequency-divided clock signal S14 as the operation clock signal S3, and hence the frequency of the operation clock signal S3 becomes 1/4 of the base clock frequency f3. Therefore, the count-up speed of the up/down counter 118 is increased.

At time t13, the drive current $I_{LED}$ becomes larger than 1.4 times the targeted value Iref. The operation clock selector circuit 150 selects the base clock signal S8 as the operation clock signal S3, and hence the frequency of the operation clock signal S3 becomes equal to the base clock frequency f3. Therefore, the count-up speed of the up/down counter 118 is increased further. That is, the up/down counter 118 counts the control digital value faster when the difference between the magnitude of the drive current $I_{LED}$ and the targeted value Iref is larger.

At time t14, the drive current $I_{LED}$ becomes smaller than 1.4 times the targeted value Iref. The operation clock selector circuit 150 selects the ¼ frequency-divided clock signal S14 as the operation clock signal S3, and hence the frequency of the operation clock signal S3 becomes ¼ of the base clock frequency f3. Therefore, the count-up speed of the up/down counter 118 is decreased.

At time t15, the drive current $I_{LED}$ becomes smaller than 1.15 times the targeted value Iref. The operation clock selector circuit 150 selects the 1/16 frequency-divided clock signal S15 as the operation clock signal S3, and hence the frequency of the operation clock signal S3 becomes 1/16 of the base clock frequency f3. Therefore, the count-up speed of the up/down counter 118 is made equal to that before time t12.

When the input voltage Vin varies from a sudden change voltage to the supply voltage, the semiconductor light source lighting circuit 100 operates in the same manner as described above except that the variation directions are opposite.

In the semiconductor light source lighting circuit 100, PWM dimming is realized by rendering the switching regulator 104 itself inactive periodically. With this measure, the magnitude of a current flowing through the LEDs at the time of off-to-on switching can be made smaller than in a case that, for example, PWM dimming is realized by turning on/off a switch that is provided between the switching regulator 104 and the LEDs. This makes it possible to use, as elements of the semiconductor light source lighting circuit 100, less expensive devices that are lower in breakdown voltage and breakdown current as well as to increase the efficiency of the semiconductor light source lighting circuit 100.

In the semiconductor light source lighting circuit 100 according to the embodiment, the register 162 holds a control digital value while the switching regulator 104 is in an inactive state. This makes it possible to smoothly connect values of the drive current $I_{LED}$ occurring in an active state that is before and after the inactive state.

In the semiconductor light source lighting circuit 100 according to the embodiment, the error amount is digitized as the control digital value. That is, the processing of acquiring the duty ratio setting signal S4 from the detection voltage Vd is digitized by means of the error comparator 116, the up/down counter 118, and the D/A converter 120. As a result, unlike in a case that the above processing is performed in an analog manner, it is not necessary to provide, for example, a capacitor having a relatively large capacitance for holding an error amount, whereby the circuit scale can be reduced.

In the semiconductor light source lighting circuit 100 according to the embodiment, PWM dimming is realized by pulse-modulating the input voltage Vin. As a result, the number of signal lines between the engine controller 20 and the semiconductor light source lighting circuit 100 can be decreased by one from, for example, a case that the input voltage Vin is fixed at the battery voltage Vbat and a pulse signal having the dimming frequency f1 is supplied separately from the engine controller to the semiconductor light source lighting circuit. Furthermore, it becomes unnecessary to provide an interface circuit for interpreting the pulse signal.

In the semiconductor light source lighting circuit 100 according to the embodiment, the operation clock selector circuit 150 determines whether or not the input voltage Vin is close to the supply voltage (in other words, whether the input voltage Vin is shut off or not) on the basis of the magnitude of the drive current $I_{LED}$ rather than the input voltage Vin. When the input voltage Vin is shut off in the engine controller 20, the drive current $I_{LED}$ decreases faster than the input voltage Vin. Therefore, the use of the drive current $I_{LED}$ for the shutoff determination makes it possible to detect a shutoff of the input voltage Vin (i.e., hold a control digital value) at a time that is closer to a time of the shutoff itself. As a result, useless variation of the control digital value can be suppressed.

Another method for detecting a shutoff of the input voltage Vin at a time that is closer to a time of the shutoff itself would be to set the first POR voltage Vd1 closer to the supply voltage and determine whether the input voltage Vin is shut off or not using the POR signal S11. However, usually, the POR signal S11 is used for resetting and cancellation of resetting of circuit elements. Therefore, if the first POR voltage Vd1 were set too close to the supply voltage, the circuit operation would become prone to be rendered unstable due to noise that is superimposed on the input voltage Vin. In contrast, the semiconductor light source lighting circuit 100 according to the embodiment is less prone to such instability due to noise because whether the input voltage Vin is shut off or not is determined on the basis of the drive current $I_{LED}$.

A further method would be to separately provide a circuit for monitoring the input voltage Vin in addition to the POR circuit 146. However, this is a factor in increasing the circuit scale. In contrast, the semiconductor light source lighting circuit 100 according to the embodiment can suppress increase of the circuit scale because a detection result of the current detector 112 which is provided for current feedback control is also used for a determination made in the operation clock selector circuit 150.

Another method for holding a control digital value while the switching regulator 104 is in the inactive state would be to suspend a counting operation of the up/down counter 118 on the basis of the POR signal S11 instead of using the register 162. In FIG. 3, how the control digital value varies in this case is shown by a broken line. In this case, since time t4 when the POR signal S11 turns to the low level is relatively distant from time t1 when the input voltage Vin is shut off, the control digital value decreases to a large extent in that period. A control digital value that is a result of such a large drop is held at time t4. Therefore, after supply of the input voltage Vin is restarted at time t5, it takes long time for the control digital value to return to a value at time t1. The drive current $I_{LED}$ overshoots in a manner indicated by a broken line and the overshoot lasts long time.

In contrast, in the semiconductor light source lighting circuit 100 according to the embodiment, a shutoff is detected on the basis of the drive current $I_{LED}$ and, when a shutoff is detected, a current control digital value is held by the register 162. When the switching regulator 162 returns to the active state, the up/down counter 118 reads the control digital value from the register 162. With this measure, an original control digital value can be restored in a shorter time after a restart of supply of the input voltage Vin irrespective of whether or not the up/down counter 118 continues a counting operation while the input voltage Vin is shut off. Thus, an overshoot of the drive current $I_{LED}$ can be suppressed. As a result, the probability that the magnitude of the drive current $I_{LED}$ exceeds the breakdown current of the LEDS used in the LED light source 40 can be reduced. Or it becomes possible to use LEDs that are less expensive and lower in breakdown current.

In many cases, LEDs as a light source of a vehicular lamp are mounted on a board and supplied with power via bonded wires. In the semiconductor light source lighting circuit 100 according to the embodiment, since an overshoot of the drive current $I_{LED}$ can be suppressed, an excess current is not prone to flow through portions that are sensitive to an excess current such as bonded wires.

Furthermore, the suppression of an overshoot makes it possible to suppress temperature increase in the LED light source 40 and circuits around it.

When the input voltage Vin changes suddenly in the non-dimming mode, unless a certain countermeasure is taken, there may occur an event that the control digital value cannot properly respond to the variation of the input voltage Vin and the drive current $I_{LED}$ overshoots or undershoots to a large extent. How the control digital value and the drive current $I_{LED}$ vary in such a case is shown in FIG. 4 by broken lines. As the input voltage Vin varies from 13 V to 16 V, the control digital value varies relatively slowly from a value for controlling the drive current $I_{LED}$ to a targeted value Iref for the input voltage Vin of 13 V to a value for controlling the drive current $I_{LED}$ to a targeted value Iref for the input voltage Vin of 16 V. More specifically, where the switching regulator 104 is of a voltage boost type, the control digital value varies slowly so as to decrease the on duty ratio of the switching element 122. Since the control digital value varies more slowly than the input voltage Vin, the on duty ratio remains relatively large even when the input voltage Vin has reached 16 V. Therefore, large energy is supplied to the LED light source 40 and the drive current $I_{LED}$ may overshoot. When the input voltage Vin varies from 16 V to 13 V, the semiconductor light source lighting circuit operates in an opposite manner and the drive current $I_{LED}$ may undershoot.

In contrast, in the semiconductor light source lighting circuit 100 according to the embodiment, the up/down counter 118 counts the control digital value faster when the difference between the magnitude of the drive current $I_{LED}$ and the targeted value Iref is larger. That is, whereas the up/down counter 118 is caused to operate with a clock signal having a relatively low frequency to suppress oscillation when the drive current $I_{LED}$ is close to the targeted value Iref, the up/down counter 118 is caused to operate with a clock signal having a higher frequency as the detection value of the drive current $I_{LED}$ goes away from the targeted value Iref to cause the drive current $I_{LED}$ to converge to the targeted value Iref quickly. As a result, even when the input voltage Vin changes suddenly, the control digital value can follow the variation of the control digital value more quickly, whereby an overshoot or an undershoot of the drive current $I_{LED}$ as well as deterioration of the LED light source 40 can be suppressed.

When the drive current $I_{LED}$ undershoots to a large extent, the light emission of the LED light source 40 may become weaker. In the semiconductor light source lighting circuit 100 according to the embodiment, the light emission of the LED light source 40 can be kept stable because an undershoot of the drive current $I_{LED}$ is suppressed.

If the POR signal S11 does not turn to the low level even when the input voltage Vin changes suddenly, the up/down counter 118 does not load a digital value being held by the register 162. Therefore, in this case, the above-described advantages are obtained irrespective of how the register 162 operates.

The drive current $I_{LED}$ tends to overshoot when the number of effective LEDs of the LED light source 40 is decreased by opening/closure of the bypass switches, and tends to undershoot when number of effective LEDs of the LED light source 40 is increased. The semiconductor light source lighting circuit 100 according to the embodiment can also suppress such an overshoot and undershoot.

Even if the semiconductor light source lighting circuit has the function of accelerating a counting operation at the time of a sudden change of the input voltage Vin but does not have the function of holding and reading out a control digital value in the PWM dimming mode, it can accommodate a sudden change of the input voltage Vin in the above-described manner. However, when the supply of the input voltage Vin is shut off in the PWM dimming mode, the control digital value goes away from an original value faster as the drive current $I_{LED}$ deviates more from the targeted value Iref. How the control digital value varies in such a case shown in FIG. 3 by a two-dot chain line. Therefore, when supply of the input voltage Vin is restarted, the drive current $I_{LED}$ overshoots more than in a case that the function of accelerating a counting operation at the time of a sudden change of the input voltage Vin is not provided.

In view of the above, the semiconductor light source lighting circuit 100 according to the embodiment has both of the function of holding and reading out a control digital value in the PWM dimming mode and the function of accelerating a counting operation at the time of a sudden change of the input voltage Vin. Therefore, when the input voltage Vin has been shut off in the PWM dimming mode, the register 162 holds a control digital value before the variation rate of the control digital value is increased by the latter function. Thus, an overshoot of the drive current $I_{LED}$ can be suppressed when supply of the input voltage Vin is restarted.

In the semiconductor light source lighting circuit 100 according to the embodiment, the common criterion is used for determining whether the input voltage Vin is shut off or not and for determining whether to accelerate a counting operation of the up/down counter 118. That is, when the drive current $I_{LED}$ goes out of the error range, it is determined that the input voltage Vin is shut off and the frequency of the operation clock signal S3 is increased. Therefore, the circuit scale can be made smaller than in a case that determination circuits dedicated to respective criteria are provided sparately.

The configuration and operation of the semiconductor light source lighting circuit 100 according to the embodiment has been described above. However, the embodiment is just an example, and it would be understood by a person skilled in the art that various modifications are possible in terms of combinations of constituent elements or pieces of processing and the scope of the invention encompasses such modifications.

For example, the technical concept of the embodiment can also be applied to a case that the supply voltage changes suddenly in the PWM dimming mode.

Although in the embodiment the first control power circuit 130 and the second control power circuit 140 are provided parallel with each other, the invention is not limited to such a case. When the input voltage Vin has become a voltage around the ground potential $V_{GND}$, only the power voltage that is supplied to the register 162 may be maintained. Alternatively, voltages supplied to not only the register 162 but also circuits around it may be maintained. As a further alternative, the entire digital circuit may continue to be supplied with power. In any case, it is desirable to suspend a clock signal for operation of the digital circuit. This makes it possible to prevent state variations and reduce the power consumption.

Figure 5:
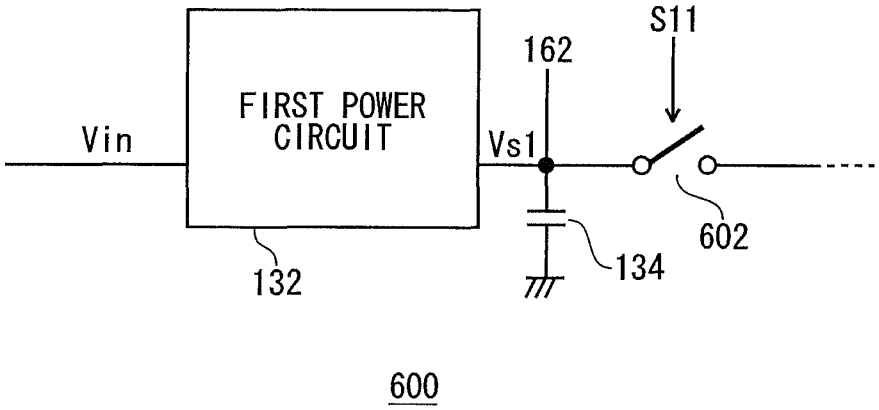
FIG. 5 is a circuit diagram showing the configuration of a modified version of a first control power circuit shown in FIG. 1.

FIG. 5 is a circuit diagram showing the configuration of a modified version of the first control power circuit 130. A first control power circuit 600 according to the modification is equipped with the first power circuit 132, the first capacitor 134, and a power switching element 602. The power switching element 602 is on/off-controlled by the POR signal S11. When the POR signal S11 is at the high level, the power switching element 602 is switched on and also supplies the first power voltage Vs1 to the circuit elements other than the register 162 of the semiconductor light source lighting circuit 100. When the POR signal S11 is at the low level, the power switching element 602 is switched off and the supply of power to the circuit elements other than the register 162 is shut off. This modification can reduce the circuit scale because the second control power circuit 140 is not necessary.

In the embodiment, in the PWM dimming mode, the POR signal S11 turns to the high level after turning-on of the up/down counter 118. However, the invention is not limited to such a case. For example, the first control power circuit 130 may supply a power voltage to the up/down counter 118. In this case, the up/down counter 118 is kept on even while the input voltage Vin is shut off. Therefore, the up/down counter 118 reads digital values from the register 162 after time t4 when the POR signal turns to the low level. As a result, whenever the POR signal turns to the high level thereafter and counting of the control digital value is restarted, the control digital value occurring at the time of the restart of counting is equal to a control digital value that occurred at time t2.

Although in the embodiment the semiconductor light source lighting circuit 100 has both of the function of holding and reading out a control digital value in the PWM dimming mode and the function of accelerating a counting operation at the time of a sudden change of the input voltage Vin, the invention is not limited to such a case. For example, where the PWM dimming mode is not used, it is possible to provide a semiconductor light source lighting circuit capable of suppressing an overshoot or an undershoot of the drive current which may occur when the input voltage changes suddenly, by providing the semiconductor light source lighting circuit with the latter function but not the former function. Furthermore, it is possible to provide a semiconductor light source lighting circuit capable of suppressing an overshoot of the drive current in the PWM dimming mode, by providing the semiconductor light source lighting circuit with the former function but not the latter function.

While aspects of embodiments of the present invention have been shown and described above, other implementations are within the scope of the claims. It will be understood by those skilled in the art that various changes in form and details may be made therein without departing from the spirit and scope of the invention as defined by the appended claims.

What is claimed is:

1. A circuit for lighting a semiconductor light source, the circuit comprising:

a switching regulator comprising a switching element and configured to generate a drive current for the semiconductor light source from an input voltage using the switching element, wherein the input voltage varies between a first voltage corresponding to an active state of the switching regulator and a second voltage corresponding to an inactive state of the switching regulator repeatedly, and wherein the switching regulator generates the drive current in the active state, and the switching regulator does not generate the drive current in the inactive state; and a control circuit configured to control on-off of the switching element such that the magnitude of the drive current comes close to a targeted value, the control circuit comprising:

a comparator configured to compare the magnitude of the drive current with the targeted value;

an up/down counter configured to count a digital value in a counting-up direction or a counting-down direction, based on a comparison result of the comparator;

a determination circuit configured to determine whether or not the input voltage deviates from the first voltage based on the magnitude of the drive current;

a register configured to acquire the counted digital value and hold the acquired digital value while the determination circuit determines that the input voltage deviates from the first voltage;

a digital-to-analog converter configured to convert the counted digital value into an analog signal; and a drive circuit configured to control on-off of the switching element based on the analog signal, wherein the up/down counter reads out the digital value held by the register as a digital value counted by the up/down counter when the switching regulator makes a transition from the inactive state to the active state.

2. A circuit for lighting a semiconductor light source, the circuit comprising:

a switching regulator comprising a switching element and configured to generate a drive current for the semiconductor light source from an input voltage using the switching element, wherein the input voltage varies between a first voltage corresponding to an active state of the switching regulator and a second voltage corresponding to an inactive state of the switching regulator repeatedly; and a control circuit configured to control on-off of the switching element such that the magnitude of the drive current comes close to a targeted value, the control circuit comprising:

a comparator configured to compare the magnitude of the drive current with the targeted value;

an up/down counter configured to count a digital value in a counting-up direction or counting-down direction, based on a comparison result of the comparator;

a digital-to-analog converter configured to convert the counted digital value into an analog signal; and a drive circuit configured to control on/off of the switching element based on the analog signal, wherein the up-down counter is configured to count the digital value at a higher rate as a difference between the magnitude of the drive current and the targeted value is increased.

3. The circuit according to claim 2, wherein the control circuit further comprises:

a clock generator configured to generate a clock signal such that the frequency of the generated clock signal is higher as the difference between the magnitude of the drive current and the targeted value is increased, wherein the up/down counter is configured to count the digital value based on the generated clock signal.

4. The circuit according to claim 3, wherein the switching regulator generates the drive current in the active state, and the switching regulator does not generate the drive current in the inactive state, wherein the control circuit further comprises:

a determination circuit configured to determine whether or not the input voltage deviates from the first voltage based on the magnitude of the drive current; and a register configured to acquire the counted digital value and hold the acquired digital value while the determination circuit determines that the input voltage deviates from the first voltage, wherein the up/down counter reads out the digital value held by the register as a digital value counted by the up/down counter when the switching regulator makes a transition from the inactive state to the active state.

5. A circuit for lighting a semiconductor light source, the circuit comprising:

a switching regulator comprising a switching element and configured to generate a drive current for the semiconductor light source using the switching element, wherein the switching regulator is configured to generate the drive current from an input voltage using the switching element, the input voltage varies between a first voltage corresponding to an active state of the switching regulator and a second voltage corresponding to an inactive state of the switching regulator repeatedly; and a control circuit configured to control on-off of the switching element such that the magnitude of the drive current comes close to a targeted value, the control circuit comprising:

a comparator configured to compare the magnitude of the drive current with the targeted value;

an up/down counter configured to count a digital value in a counting-up direction or counting-down direction, based on a comparison result of the comparator;

a digital-to-analog converter configured to convert the counted digital value into an analog signal;

a drive circuit configured to control on/off of the switching element based on the analog signal, wherein the up-down counter is configured to count the digital value at a higher rate as a difference between the magnitude of the drive current and the targeted value is increased, and a determination circuit configured to determine whether or not the input voltage deviates from the first voltage based on the magnitude of the drive current, wherein the up/down counter counts the digital value at a higher rate when the determination circuit determines that the input voltage deviates from the first voltage than when the determination circuit determines that the input voltage does not deviate from the first voltage.

* * * * *